US009019798B2

(12) United States Patent
Patterson et al.

(10) Patent No.: US 9,019,798 B2
(45) Date of Patent: Apr. 28, 2015

(54) ACOUSTIC RECEPTION

(71) Applicant: Halliburton Energy Services, Inc., Houston, TX (US)

(72) Inventors: Robert Brice Patterson, Duncan, OK (US); Stephen E. Tilghman, Marlow, OK (US); Dustin Robert Holden, Fletcher, OK (US); John Patrick Rodgers, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 378 days.

(21) Appl. No.: 13/725,136

(22) Filed: Dec. 21, 2012

(65) Prior Publication Data

US 2014/0177392 A1 Jun. 26, 2014

(51) Int. Cl.
*E21B 47/16* (2006.01)

(52) U.S. Cl.
CPC ..... *E21B 47/16* (2013.01)

(58) Field of Classification Search
CPC ..... E21B 47/14; E21B 47/16; E21B 47/0905
USPC ..... 340/853.1–856.3; 367/81–85; 166/66, 166/254.2
See application file for complete search history.

(56) References Cited

U.S. PATENT DOCUMENTS 3,833,248 A * 9/1974 Wossner et al. ..... 293/134
3,916,699 A 11/1975 Moran et al.
4,314,365 A 2/1982 Petersen et al.
5,812,068 A * 9/1998 Wisler et al. ..... 340/855.5
6,320,820 B1 11/2001 Gardner et al.
6,370,082 B1 4/2002 Gardner et al.
6,880,634 B2 4/2005 Gardner et al.
6,896,056 B2 * 5/2005 Mendez et al. ..... 166/254.2
7,324,010 B2 1/2008 Gardner et al.
7,325,605 B2 2/2008 Fripp et al.
7,348,892 B2 3/2008 Rodney
7,557,492 B2 7/2009 Fripp et al.

(Continued)

FOREIGN PATENT DOCUMENTS

WO 02099250 A1 12/2002

OTHER PUBLICATIONS

Foreign communication from a related counterpart application—International Search Report and Written Opinion, PCT/US2013/074721, Oct. 16, 2014, 10 pages.

*Primary Examiner* — Hai Phan
*Assistant Examiner* — Royit Yu

(57) ABSTRACT

A pressure-balanced acoustic-signal-receiving apparatus and methods therefor. The apparatus may comprise a first housing, a first actuator, a second housing, and a second actuator. The first housing may comprise a fluid chamber, a passage connecting a first and second portion of the fluid chamber, a tubular-contact assembly, an isolating member within the fluid chamber and coupled to the assembly, an acoustic-signal receiver within the isolating member and coupled to the assembly, and a communication member coupled to the receiver. A method for receiving an acoustic signal generated within a wellbore may comprise receiving the acoustic signal with a tubular-contact assembly, sensing the acoustic signal with an acoustic-signal receiver positioned within a fluid chamber and coupled to the assembly, equilibrating fluid pressures in the first and second portions of the fluid chamber, and transmitting information generated by the acoustic-signal receiver through a communication member.

20 Claims, 5 Drawing Sheets

(56) References Cited

U.S. PATENT DOCUMENTS

| | | | | |
|---|---|---|---|---|
| 7,595,737 | B2 | 9/2009 | Fink et al. | |
| 7,781,939 | B2 | 8/2010 | Fripp et al. | |
| 8,701,784 | B2 * | 4/2014 | Huseman et al. | 166/377 |
| 8,899,322 | B2 * | 12/2014 | Cresswell et al. | 166/255.1 |
| 2004/0156264 | A1 | 8/2004 | Gardner et al. | |
| 2006/0266602 | A1 * | 11/2006 | Robertson | 188/322.15 |
| 2007/0284117 | A1 | 12/2007 | Smithson | |
| 2012/0152519 | A1 | 6/2012 | Rodgers et al. | |
| 2013/0081377 | A1 * | 4/2013 | Burger | 60/273 |

* cited by examiner

ACOUSTIC RECEPTION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow recovery of the hydrocarbons. A tubular string may be placed in a wellbore for drilling and/or production of fluids from the wellbore. In some wellbores, an acoustic telemetry system can transmit wellbore information using vibrations in the wall of the tubular string. The vibrations can be generated by an acoustic transmitter mounted on the tubing wall of the tubular string, and the vibrations can be transmitted up the tubular string to an acoustic receiver. The configuration of the acoustic receiver relative to the tubular string can affect the quality of the reception of the transmitted vibrations.

SUMMARY

Disclosed herein is a pressure-balanced acoustic-signal-receiving apparatus having a first housing, a first actuator coupled to the first housing, a second housing, and a second actuator coupled to the second housing, the first housing comprising a fluid chamber comprising a first portion and a second portion, a passage fluidly connecting the first portion and the second portion, a tubular-contact assembly having an end positioned in the first portion of the fluid chamber, wherein the tubular-contact assembly comprises a contact surface configured to contact a tubular wall, an isolating member positioned within the fluid chamber and coupled to the tubular-contact assembly, an acoustic-signal receiver coupled to the tubular-contact assembly and positioned within the isolating member, and a communication member coupled to the acoustic signal receiver.

Also disclosed herein is a method for receiving an acoustic signal generated within a wellbore comprising receiving the acoustic signal with a tubular-contact assembly, sensing the acoustic signal with an acoustic-signal receiver positioned within a fluid chamber and coupled to the tubular-contact assembly, equilibrating a fluid pressure in a first portion of the fluid chamber with a fluid pressure of a second portion of the fluid chamber, and transmitting information generated by the acoustic-signal receiver through a communication member.

Further disclosed herein is a method for receiving an acoustic signal generated within a wellbore comprising contacting a tubular wall with a first contact force, contacting the tubular wall with a second contact force, receiving an acoustic signal with a tubular-contact assembly, sensing the acoustic signal with an acoustic-signal receiver positioned within a fluid chamber and coupled to the tubular-contact assembly, and equilibrating a pressure in a first portion of the fluid chamber with a pressure of a second portion of the fluid chamber, wherein the first contact force is greater than the second contact force.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
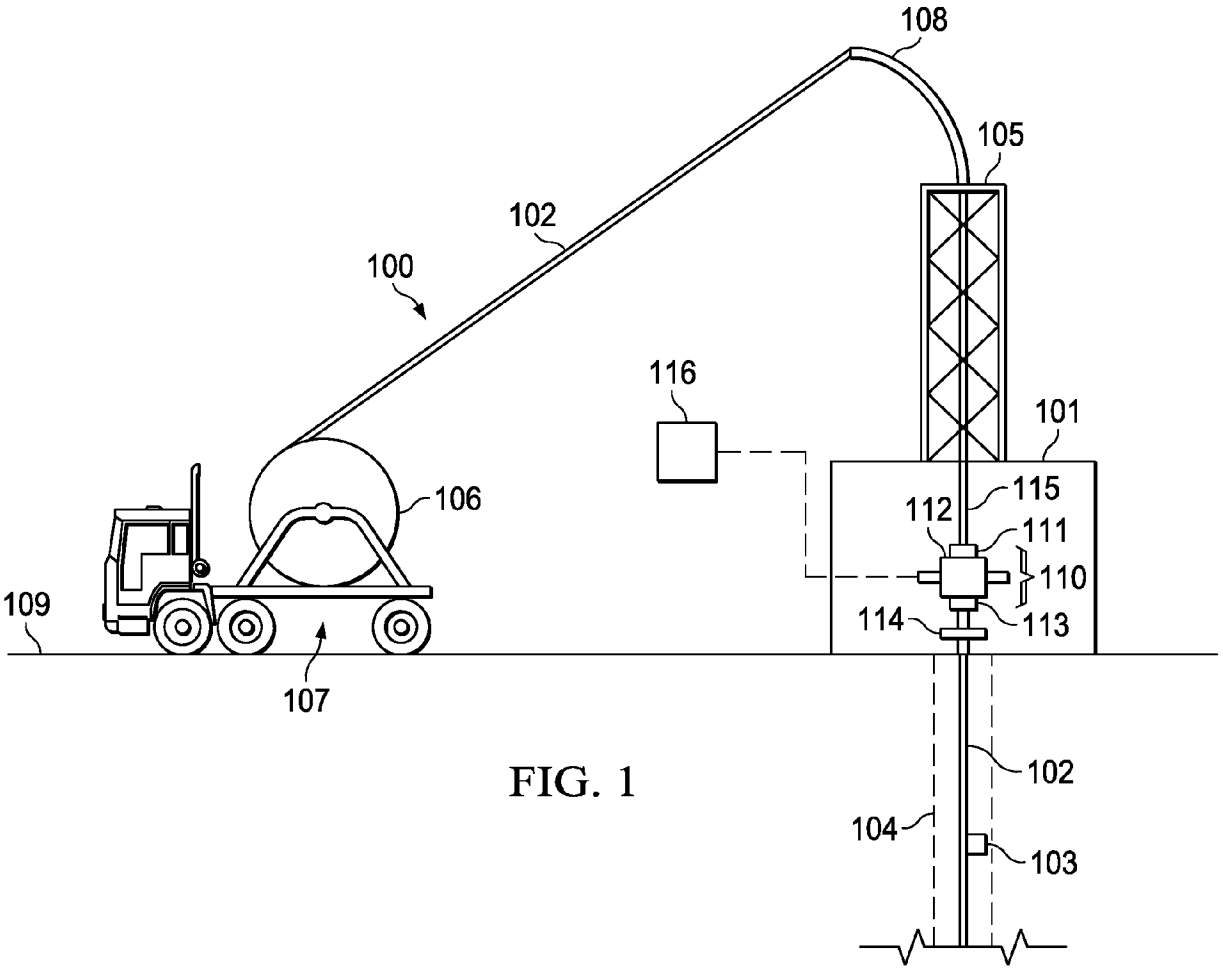
FIG. 1 illustrates a schematic view of a general wellbore operating environment having an acoustic telemetry system which utilizes the pressure-balanced acoustic-signal-receiving apparatus.

In the drawings and description that follow, like parts are typically marked throughout the specification and drawings with the same reference numerals, respectively. The drawing figures are not necessarily to scale. Certain features may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of principles, and is not intended to limit the claims to the embodiments illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are embodiments of a pressure-balanced acoustic-signal-receiving apparatus and method for receiving an acoustic signal generated within a wellbore. The disclosed embodiments generally relate to acoustic telemetry systems in wellbore operations. In embodiments, the apparatus and method generally operate so that a tubular-contact assembly and associated acoustic-signal receiver have a free-floating configuration. That is, in the disclosed embodiments, the force and/or pressure exerted on the tubular wall by the tubular-contact assembly of the apparatus is at least partially independent of the force and/or pressure exerted on the tubular by other components of the apparatus.

FIG. 1 illustrates a schematic view of a general wellbore operating environment having an acoustic telemetry system 100 which utilizes the pressure-balanced acoustic-signal-receiving apparatus 112. The acoustic telemetry system 100 may be utilized during hydrocarbon production, water production, workover procedures, treatment procedures, or combinations thereof. The system 100 may have a supply (e.g., mobile supply) of tubular string 102 (e.g., coiled tubing on a spool 106) which may be conveyed through a support structure 105 and injector 111 into a wellbore 104. The wellbore 104 may have a wellhead 114 and Christmas tree 110 associated therewith. In the system 100 shown in FIG. 1, a pressure-balanced acoustic-signal receiving apparatus (hereinafter "PBASR apparatus") 112 may be associated with the Christmas tree 110 and may receive acoustic signals transmitted up the tubular string 102 and generated by an acoustic signal generator 103 positioned within the wellbore 103. In an embodiment, the tubular string 102 may extend through various wellhead equipment, e.g., the Christmas tree 110 comprising the injector 111, the PBASR apparatus 112, and a master valve or blow out preventer 113.

In embodiments, the support structure 105 (e.g., a mast or derrick) is generally positioned above the wellbore 104. The support structure, coupled with a gooseneck 108, may support the tubular string 102 above the wellbore 104. In embodiments, the support structure 105 may be supported by a substructure 101. The injector 111 is a mechanical device positioned above the wellbore 104 that may by associated with the Christmas tree 110. The injector 111 may move the tubular string 102 into and out of the wellbore 104. In an embodiment, the injector 111 may pull the tubular string 102 from the spool 106, straighten the tubular string 102, and inject the tubular string 102 into the wellbore 104 through any equipment below the injector 111 (e.g., the PBASR apparatus 112 and master valve 113) and through the wellhead 114. In an embodiment, the injector 111 may inject greater than about 1,000 ft of tubular string 102 into wellbore 104; alternatively, greater than 2,500 ft; alternatively, greater than about 5,000 ft. In an embodiment, the injector 111 may raise and lower the tubular string 102 during a downhole operation, during production, or combinations thereof.

The wellbore 104 may extend substantially vertically away from the surface 109 (e.g., land-based surface as shown in FIG. 1, or sub-sea surface). In additional or alternative operating environments, all or a portion of the wellbore 104 may be vertical, deviated at any suitable angle, horizontal, and/or curved. The wellbore 104 may comprise a new wellbore, an existing wellbore, a straight wellbore, an extended reach wellbore, a sidetracked wellbore, a multi-lateral wellbore, other types of wellbores for drilling and completing one or more production zones, or combinations thereof. The wellbore 104 may be drilled into a subterranean formation using any suitable drilling technique which would be recognized by those in the art with the aid of this disclosure. FIG. 1 depicts a land-based wellbore 104. In alternative embodiments, the wellbore 104 may comprise an offshore wellbore, a sub-sea wellbore, or combinations thereof.

The acoustic signal generator 103 may be associated with the tubular string 102 and positioned within the wellbore 104. The acoustic signal generator 103 may be configured to impart an acoustic signal into the tubular string 102. The acoustic signal may transmit up the tubular string 102. The acoustic signal may comprise a frequency which may be chosen according to operating conditions such as depth, tubular size, whether the tubular string 102 comprises coiled or jointed tubulars, etc., or combinations thereof. In embodiments, the acoustic signal may comprise a frequency in a range of about 1,000 to about 3,000 Hz. In embodiments, the acoustic signal may travel in directions parallel to axis 306, parallel to axis 304, or both (axes 304 and 306 are shown in FIG. 3B). The acoustic signal generator 103 may comprise any generator that would be recognized by those skilled in the art with the aid of this disclosure, e.g., piezoelectric transmitters such as piezoelectric washers.

The PBASR apparatus 112 may be associated with a tubular wall 115 of the tubular string 102. Generally, the tubular string 102 may pass through the PBASR apparatus 112. In embodiments, the PBASR apparatus 112 may detect the acoustic signal generated by generator 103 and transmitted up the tubular string 102. As shown in FIG. 1, the PBASR apparatus 112 may be positioned at the surface 109 between components, e.g., injector 111 and master valve 113, of a Christmas tree 110. In alternative embodiments, the PBASR apparatus 112 may be positioned proximate the surface 109 externally of the Christmas tree 110. In an embodiment, the PBASR apparatus 112 may receive the acoustic signal and convert the acoustic signal to information (e.g., an electric signal). In an embodiment, the PBASR apparatus 112 may transmit the information, for example, to data processor 116.

The data processor 116 may receive the information (e.g., an electric signal) from the PBASR apparatus 112 by any suitable method, such as wireless information communication or wired information communication. In embodiments, the data processor 116 may comprise a computer having a processor and/or memory capable of executing instructions for processing data related to the acoustic telemetry system 100. The data processor 116 may additionally or alternatively comprise a data store. In embodiments, the data processor 116 may be configured to record the information (e.g., electric signal(s)) transmitted by the PBASR apparatus 112. The data processor 116 may comprise any form recognized by those skilled in the art with the aid of this disclosure. Likewise, the form of communication between the data processor 116 and the PBASR apparatus 112 may comprise any form recognized by those skilled in the art with the aid of this disclosure.

Figure 2A:
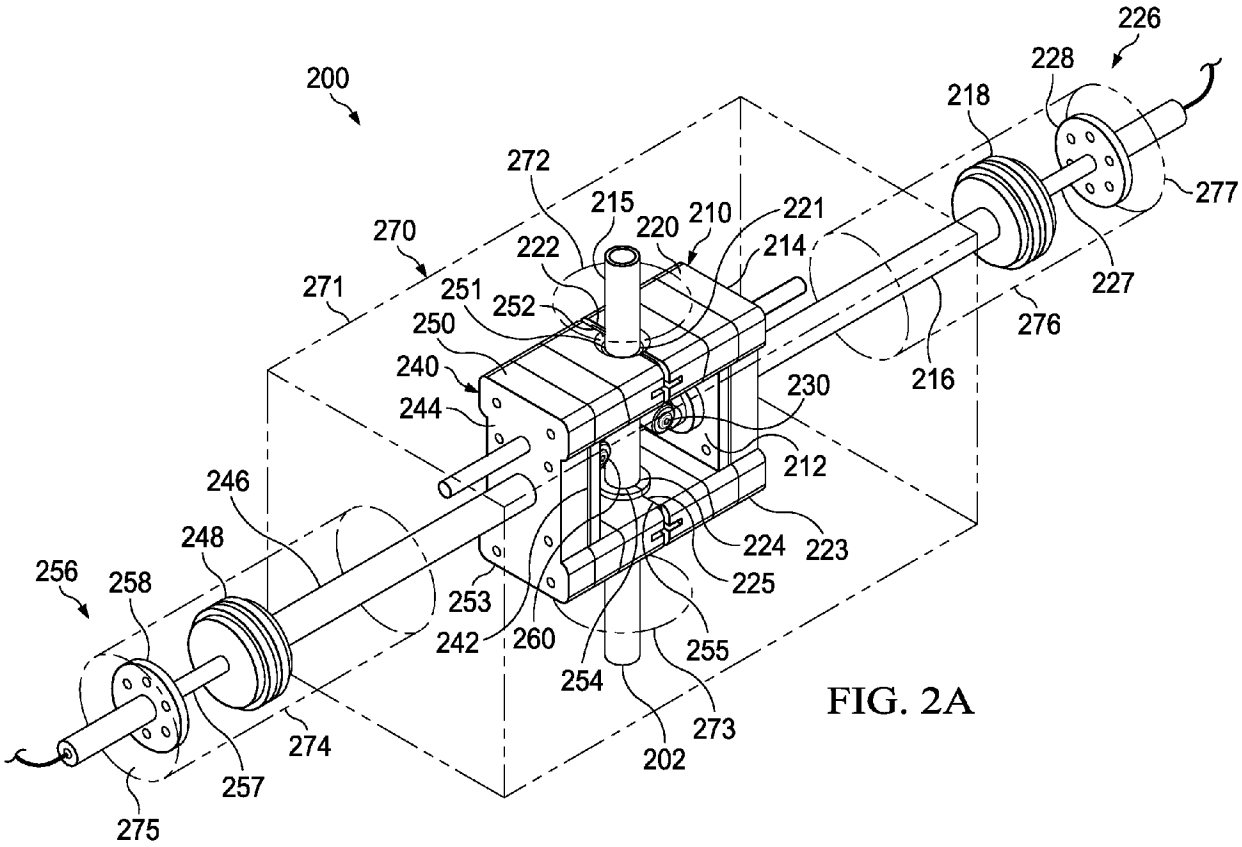
FIGS. 2A and 2B illustrate perspective views of an embodiment of the disclosed pressure-balanced acoustic-signal-receiving apparatus.
Figure 2B:
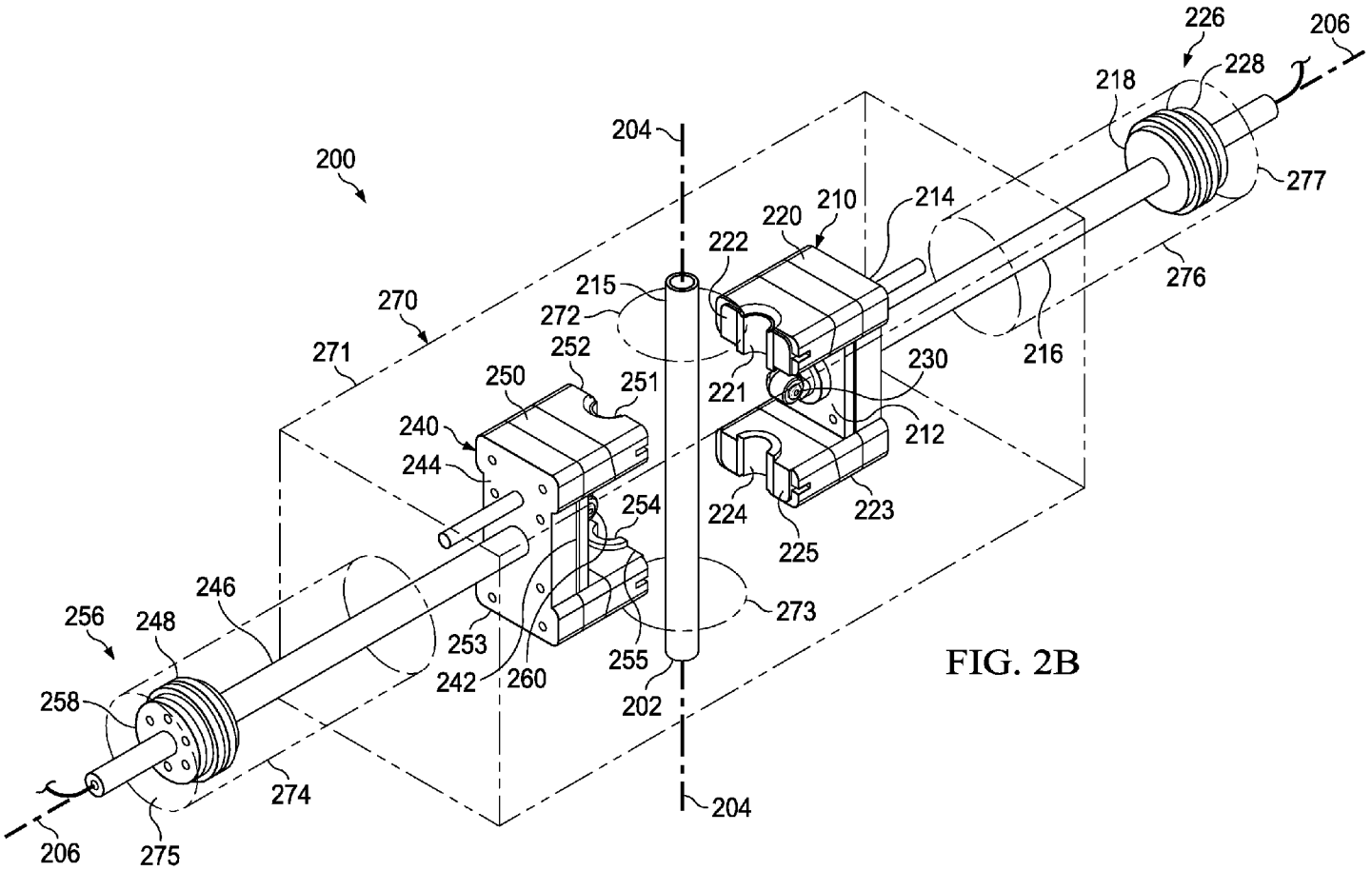

FIGS. 2A and 2B illustrate perspective views of an embodiment of the PBASR apparatus 200 in different positions. The PBASR apparatus 200 may move between the positions as needed. For example, the PBASR apparatus 200 may extend the tubular-contact assembly 230 and/or tubular-contact assembly 260 along axis 206 to contact the tubular wall 215 (e.g., FIG. 2A), may retract the tubular-contact assembly 230 and/or tubular-contact assembly 260 along axis 206 from contact with the tubular wall 215 (e.g., FIG. 2B), and/or may extend the tubular-contact assembly 230 and/or tubular-contact assembly 260 to re-contact the tubular wall 215 (e.g., return to FIG. 2A). The PBASR apparatus 200 may also move (e.g., extend or retract) to and from other positions along axis 206.

FIG. 2A shows the PBASR apparatus 200 may have components which extend so that a tubular wall 215 of tubular 202 is contacted (e.g., after one or more tubulars are extended into a wellbore). Tubular 202 may comprise coiled tubing, jointed tubing, casing, liner, drill pipe, production tubing, rod strings, or combinations thereof. The PBASR apparatus 200 may comprise a first housing 210, a first actuator 226 coupled to the first housing 210, a second housing 240, and a second actuator 256 coupled to the second housing 240. The first housing 210, first actuator 226, second housing 240, and second actuator 256 may be contained in an enclosure 270 (denoted by dashed lines). The enclosure 270 may comprise a body 271, arms 274 and 276 extending from opposite sides of the body 271, flanges or openings 272 and 273 on the top and bottom of the body 271, flange 275 on end of arm 274, and flange 277 on end of arm 276. The tubular 202 may extend through flanges 272 and 273 of body 271 of enclosure 270, and between the first housing 210 and second housing 240 of the PBASR apparatus 200. Flange 272 of the enclosure 270 may couple with a flange of a component of a Christmas tree (e.g., the injector 111 as described in FIG. 1) or other wellbore operating equipment. Flange 273 of the enclosure 270 may couple with a flange of a master valve (as described in FIG. 1), or other component of the Christmas tree, or other wellbore operating equipment. Flange 277 of arm 276 of enclosure 270 may couple to a flange 228 of the first actuator 226, and flange 275 of arm 274 may couple with a flange 258 of the second actuator 256. The coupling of flanges 272, 273, 275, and 277 may create a closed environment which houses the first housing 210, first actuator, 226, second housing 240, and second actuator 256. In an embodiment, the closed environment may be pressurized, for example, with a wellbore fluid or other fluid.

As seen in the embodiment of FIG. 2A, the first actuator 226 may actuate piston rod 227 to extend the first housing 210 to contact the tubular wall 215 of tubular 202 Likewise, the second actuator 256 may actuate piston rod 257 to extend the second housing 240 to contact the tubular wall 215 of tubular 202. During actuation of the first actuator 226, the flange 228 of the first actuator 226 remains in stationary connection with flange 277 of the enclosure 270. During actuation of the second actuator 256, the flange 258 of the second actuator 256 remains in stationary connection with flange 275 of enclosure 270. In an embodiment, each of actuators 226 and 256 may comprise a mechanical actuator (e.g., a threaded rod or screw mechanism), a hydraulic actuator, a pneumatic actuator, an electro-mechanical actuator, or combinations thereof. In an embodiment, the actuators 226 and 256 may float from side-to-side.

In the embodiment shown in FIG. 2A, the first housing 210 of the PBASR apparatus 200 may comprise an upper end 220, a lower end 223, a front plate 212 positioned between the upper end 220 and lower end 223, a back member 214 coupled to the upper end 220 and lower end 223, and a rod member 216 extending outwardly from the back member 214. The rod member 216 may have an end 218 positioned in the arm 276 of the enclosure 270. A tubular-contact assembly 230 may extend through the front plate 212 and may contact a tubular wall 215 of the tubular 202.

In an embodiment, the second housing 240 of the PBASR apparatus 200 may have a configuration similar to the first housing 210. The second housing 210 of the PBASR apparatus 200 may comprise an upper end 250, a lower end 253, a front plate 242 positioned between the upper end 250 and lower end 253, a back member 244 coupled to the upper end 250 and lower end 253, and a rod member 246 extending outwardly from the back member 244. The rod member 246 may have an end 248 positioned in the arm 274 of the enclosure 270. A tubular-contact assembly 260 may extend through the front plate 242 and may contact a tubular wall 215 of the tubular 202.

In an embodiment, the upper end 220 and lower end 223 of the first housing 210 and the upper end 250 and lower end 253 of the second housing 240 may be configured to centralize the tubular 202 in relation to the wellbore in which the tubular 202, or tubular string comprising the tubular 202, may extend. In an embodiment, the first housing 210 may comprise a bushing 221 associated with upper end 220, and a bushing 224 associated with lower end 223. The second housing 240 may comprise a bushing 251 associated with upper end 250, and a bushing 254 associated with the lower end 243. Bushings 221, 251, 224, and 254 may be generally configured to contact the tubular wall 215. In an embodiment, one or more of bushings 221, 251, 224, 254 may contact the tubular wall 215 above or below the tubular-contact assembly 230. The bushings 221, 224, 251, 254 may be configured to centralize the tubular 202 with regard to the wellhead equipment and/or the wellbore in which the tubular 202, or tubular string comprising the tubular 202, may extend. The bushings 221, 224, 251, 254 may comprise a material which transmits sound waves less than metal materials, e.g., composite(s), polymer(s), plastic(s), elastomer(s), the like, or combinations thereof. The material which transmits sound waves less than metal materials may provide low noise transmission, may minimize noise generated due to contact with the tubular 202, may eliminate screech as the tubular 202 is conveyed therethrough, or combinations thereof. When first housing 210 and second housing 240 extend toward the tubular 202, the bushings 221 and 251 may form an inner diameter which is oversized in comparison to the outer diameter of tubular 202. Likewise, when first housing 210 and second housing 240 extend toward the tubular 202, the bushings 224 and 254 may form an inner diameter which is oversized in comparison to the outer diameter of tubular 202. In embodiments, the bushings 221, 251, 224, 254 may be oversized by from about 0.001 inches to about 0.050 inches. In embodiments, the bushings 221, 251, 224, 254 may be oversized by about 0.001, 0.002, 0.003, 0.004, 0.005, 0.006, 0.007, 0.008, 0.009, 0.010, 0.011, 0.012, 0.013, 0.014, 0.015, 0.016, 0.017, 0.018, 0.019, 0.020, or greater, inches. In embodiments, bushings 221, 251, 224, 254 may be oversized by about 0.015 inches; alternatively, 0.030 inches; alternatively, 0.045 inches. In an embodiment, the bushings 221, 251, 224, and 254 may be oversized by about 0.015 inches. The oversized inner diameters formed by bushings 221 and 251 and bushings 224 and 254 may allow a movement of the tubular 202 laterally, axially, or combinations thereof.

In an embodiment, the first housing 210 may comprise hard stops 222 and 225 and the second housing 240 may comprise hard stops 252 and 255. Hard stops 222, 225, 252, and 255 may be configured to limit a travel of the bushings 221, 224, 251, 254, e.g., hard stops 222 and 252 and hard stops 225 and 255 may make contact before all bushings 221, 224, 251, 254 completely compress against the tubular wall 215 of tubular 202. In an embodiment, hard stops 222, 225, 252, and 255 may ensure the bushings 221, 224, 251, 254 do not compress too tightly around the tubular wall 215 of tubular 202. Additionally or alternatively, hard stops 222, 225, 252, and 255 may ensure the housings 210 and 240 do not impede a movement of tubular 202 and/or damage the tubular 202.

In an embodiment, such as the embodiment shown in FIGS. 2A and 2B, the hard stops 222, 225, 252, and 255 may comprise metal protrusions that stick out and hit each other when housings 210 and 240 extend to surround the tubular 202. For example, hard stop 222 on upper end 220 of the first housing 210 may hit the hard stop 252 on upper end 250 of the second housing 240, and hard stop 225 on lower end 223 of the first housing 210 may hit the hard stop 255 on lower end 253 of the second housing 240. In such an embodiment, the bushings 221, 251, 224, 254 may cushion the tubular 202 between the first housing 210 and the second housing 240.

In an embodiment, as the first housing 210 and second housing 240 extend toward the tubular 202, tubular-contact assemblies 230 and 260 may contact the tubular wall 215 of tubular 202 before the bushings 221, 224, 251, 254 contact the tubular wall 215, before the hard stops 222, 225, 252, and 255 make contact, or combinations thereof. In an embodiment, one or more of the tubular-contact assemblies 230 and 260 may comprise a mechanical resonance frequency which is outside the frequency bandwidth of the acoustic signal. For example, the mechanical resonance frequency may be above and/or below the frequency bandwidth of the acoustic signal.

FIG. 2B shows the PBASR apparatus 200 may have components which retract so that the tubular wall 215 of tubular 202 is not contacted. The first actuator 226 may retract for a desired amount, for example, such that end 218 of rod member 216 abuts flange 228 of the first actuator 226. The second actuator 256 may retract a desired amount, for example, such that end 248 of rod member 246 abuts flange 258 of the second actuator 256. When the first actuator 226 retracts a desired amount, the first housing 210 moves away from the tubular wall 215 of the tubular 202. When the second actuator 256 retracts a desired amount, the second housing 240 moves away from the tubular wall 215 of the tubular 202. In an embodiment, a space is created between the first housing 210 and the second housing 240 when the first actuator 226 retracts, when the second actuator retracts 256, or combinations thereof. In an embodiment, the space may accommodate a movement of the tubular 202, a movement of wellbore operating equipment (e.g., a tool, a device, a coupling or connection such as a flange or collar, or combinations thereof) through the enclosure 270 of the PBASR apparatus 200, or combinations thereof. In an embodiment, moving wellbore operating equipment may comprise inserting a wellbore device into the wellbore past the tubular-contact assembly 230 and/or tubular-contact assembly 260.

In operation, the PBASR apparatus 200 may extend and retract the housings 210 and 240 along the axis 206 (e.g., which may be perpendicular to the longitudinal axis 204 of the tubular 202) to move the PBASR apparatus 200 to and from an extended position (see FIG. 2A), a retracted position (see FIG. 2B), or positions in between. When the housings 210 and 240 of the PBASR apparatus 200 are in the retracted position, the tubular 202 may move freely through the PBASR apparatus 200 (e.g., between the housings 210 and 240 and through flanges 272 and 273), and wellbore operations, such as movement of the tubular 202 within the wellbore or insertion of a wellbore device, may occur. When the housings 210 and 240 of the PBASR apparatus 200 are in the extended position, the wall 215 of the tubular 202 is contacted with one or more of the bushings 221, 251, 224, 254, the tubular-contact assembly 230, and the tubular-contact assembly 260. In embodiments, the tubular-contact assembly 230 may contact the tubular wall 215 of the tubular 202 before one or more of the bushings 221 and 224 contact the tubular wall 215 of the tubular 202. Likewise, the tubular-contact assembly 260 may contact the tubular wall 216 of the tubular 202 before one or more of the bushings 251 and 254 contact the tubular wall 215 of the tubular 202.

Figure 3A:
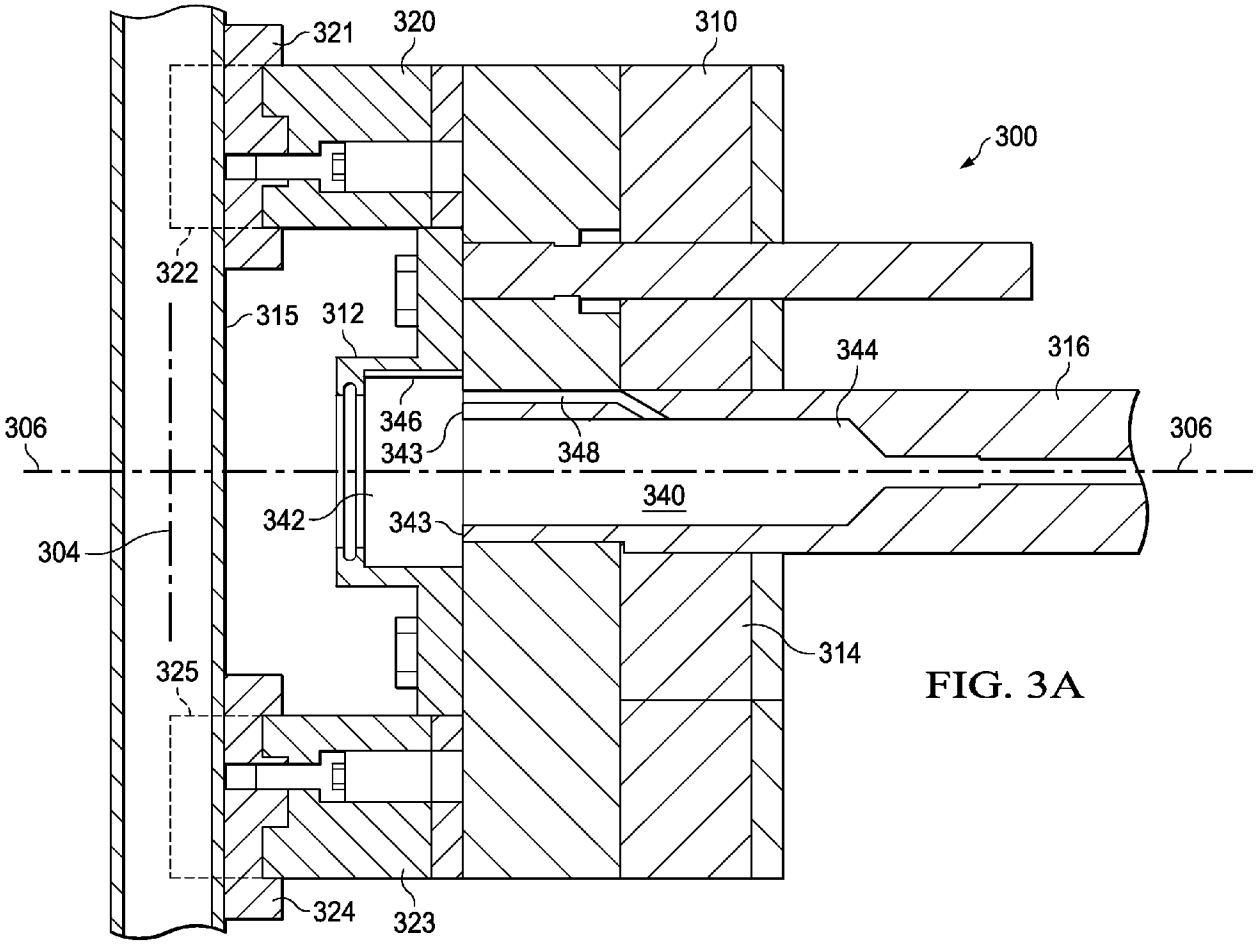
FIGS. 3A and 3B illustrate side cross-sectional views of an embodiment of a housing of the disclosed pressure-balanced acoustic-signal-receiving apparatus in contact with a tubular.
Figure 3B:
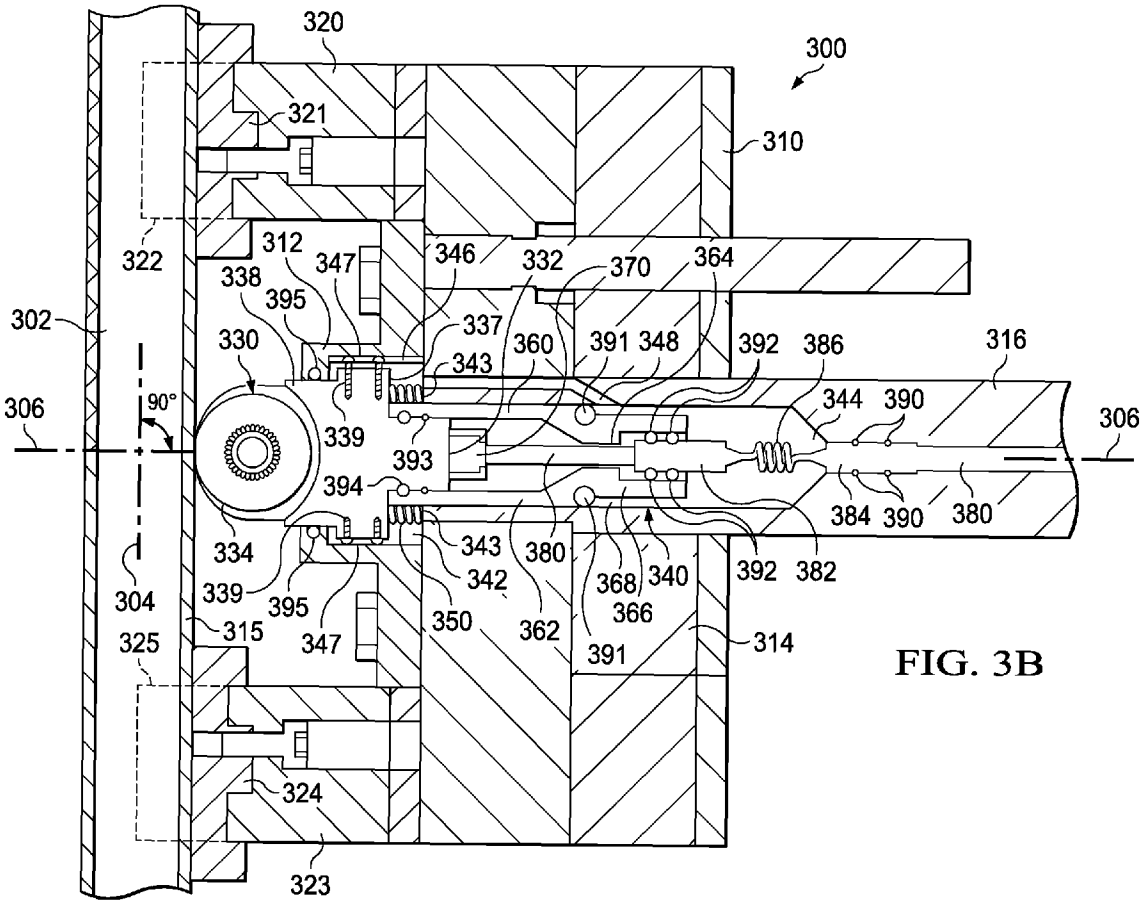

FIGS. 3A and 3B illustrate side cross-sectional views of an embodiment of a housing 310 of the PBASR apparatus 300 in contact with a tubular 302, which may be embodiments of first housing 210 and/or second housing 240 shown in FIGS. 2A and 2B.

FIG. 3A shows the housing 310 may comprise a fluid chamber 340. The upper end 320, lower end 323, bushings 321 and 324, back member 314, front plate 312, rod member 316, hard stops 322 and 325, or combinations thereof may define the fluid chamber 340 of the housing 310. The upper end 320, lower end 323, front plate 312, back member 314, rod member 316, or combinations thereof may be connected/assembled to form the fluid chamber 340 via any suitable method recognized by those skilled in the art with the aid of this disclosure, for example, by bolts, screws, nuts, adhesive, welds, straps, or combinations thereof. In an additional or alternative embodiment, the upper end 320, lower end 323, bushings 321 and 324, back member 314, front plate 312, and the rod member 316 may collectively define the fluid chamber 340.

The fluid chamber 340 may have a general T-shape, and the fluid chamber 340 may comprise a first portion 342 which is the top of the T-shape (e.g., a head portion) and a second portion 344 which is the body of the T-shape (e.g., a body portion). The first portion 342 of fluid chamber 340 may have a diameter and a length, and the second portion 344 of the fluid chamber 340 may have a diameter and a length. In an embodiment, the diameter of the second portion 344 of the T-shaped fluid chamber 340 may be less than the diameter of the first portion 342 of the T-shaped fluid chamber 340, and the length of the second portion 344 of the T-shaped fluid chamber 340 may be greater than the length of the first portion 342 of the T-shaped fluid chamber 340. Although the fluid chamber 340 is shown in FIG. 3A as having a general T-shape, it should be understood the fluid chamber 340 may have other shapes as would be understood by those skilled in the art with the aid of this disclosure.

The fluid chamber 340 may further comprise one or more wall(s) 347 which have an orientation generally perpendicular to a longitudinal axis 304 of the tubular 302, and/or generally parallel with longitudinal axis 306 of the fluid chamber 340.

A passage 348 may fluidly connect the first portion 342 of the fluid chamber 340 with the second portion 344 of the fluid chamber 340. The passage 348 may extend through the back member 314 of the housing 310, the rod member 316, or combinations thereof. In additional or alternative embodiments, the passage 348 may extend through other components of the housing 310. In an embodiment, the first portion 342 of the fluid chamber 340, the second portion 344 of the fluid chamber 340, the rod member 316, or combinations thereof may have a common longitudinal axis 306. In an embodiment, the axis 306 may be perpendicular to a longitudinal axis 304 of the tubular 302.

FIG. 3B shows the housing 310 may further comprise a tubular-contact assembly 330, an isolating member 360, an acoustic-signal receiver 370, a communication member 380, and resilient member 350. The fluid chamber 340, as described above in FIG. 3A, generally defines the chamber or cavity of the housing 310 in which the tubular-contact assembly 330, the isolating member 360, the acoustic-signal receiver 370, and the communication member 380 reside. The tubular-contact assembly 330 may have an end 332 positioned in the first portion 342 of the fluid chamber 340. The isolating member 360 may be positioned within the fluid chamber 340 and coupled to the tubular-contact assembly 330. The acoustic-signal receiver 370 may couple to the tubular-contact assembly 330 and be positioned within the isolating member 360. The communication member 380 may couple to the acoustic signal receiver 370. The resilient member 350 may be positioned in the first portion 342 of the fluid chamber 340. The structural relationships of the above-identified components of the housing 310 are discussed in more detail hereinbelow.

The tubular-contact assembly 330, the isolating member 360, the acoustic-signal receiver 370, the communication member 380, and optionally the resilient member 350 are generally coupled together such that they share a common longitudinal axis 306 which is generally perpendicular to a longitudinal axis 304 of the tubular 302. Moreover, the tubular-contact assembly 330, the isolating member 360, the acoustic-signal receiver 370, and the communication member 380 generally slide together within the fluid chamber 340 along the axis 306 in response to movements and/or vibrations (e.g., acoustic signals) of the tubular 302.

The fluid chamber 340 may be filled with a fluid such as a hydraulic fluid. In an embodiment, the first portion 342 of the fluid chamber 340 may have a fluid pressure, and the second portion 344 of the fluid chamber 340 may have a fluid pressure. In various embodiments, the fluid pressure in the first portion 342 may be greater than, less than, or about equal to the fluid pressure in the second portion 344. In an embodiment, the fluid pressure in the first portion 342 of the fluid chamber 340 is equilibrated with a fluid pressure in the second portion 344 of the fluid chamber 340, for example, via the passage 348. Alternatively, a movement of the a component of the PBASR apparatus 300 (e.g., the tubular-contact assembly 330) may create an imbalance between the fluid pressure in the first portion 342 of the fluid chamber 340 and the fluid pressure in the second portion 344 of the fluid chamber 340. In such a case, the fluid pressure in the first portion 342 of the fluid chamber 340 may equilibrate with the fluid pressure in the second portion 344 of the fluid chamber 340 in less than about 0.1 second; alternatively, in less than about 0.01 second; alternatively, in less than about 0.001 second; alternatively, about instantaneously. In an embodiment, equilibrating the fluid pressure in the first portion 342 of the fluid chamber 340 with the fluid pressure of the second portion 344 of the fluid chamber 340 may comprise flowing fluid from the first portion 342 of the fluid chamber 340 to the second portion 340 of the fluid chamber via passage 348, flowing fluid from the second portion 344 of the fluid chamber 340 to the first portion 342 of the fluid chamber 340 via the passage 348, or combinations thereof. The fluid in the fluid chamber 340 may act as a spring against the tubular-contact assembly 330 and may provide a stiffening effect on the movement of the tubular-contact assembly 330.

The fluid chamber 340 may further comprise a lip 346 (alternatively, a keying feature), e.g., formed on the front plate 312 within the first portion 342 of the fluid chamber 340, which may guide a movement of one or more of the guide members 339 of the tubular-contact assembly 330 within the first portion 342 of the fluid chamber 340. The lip 346 may have an orientation generally perpendicular to the longitudinal axis 304 of the tubular 302 and/or generally parallel to axis 306. In an embodiment, the lip 346 helps prevent the movement of the tubular-contact assembly 330 within the fluid chamber 340 in directions other than a direction perpendicular to the longitudinal axis 304 and/or a direction generally along axis 306. That is, the lip 346 may allow longitudinal motion along axis 306 while preventing rotational movement along axis 306. In embodiments, the lip 346 may comprise a bar which extends inwardly from the wall 347 of the fluid chamber 340 into the first portion 342 of the fluid chamber 340. In alternative or additional embodiments, the lip 346 may comprise a channel, groove, or combinations thereof, which guides a movement of the guide members 339.

As seen in the embodiment of FIG. 3B, the passage 348 may be formed through the back member 314 of the housing 310. In additional or alternative embodiments, the passage 348 may extend through the tubular-contact assembly 330, the back member 314, the isolating member 360, the rod member 316, or combinations thereof. The passage 348 may have any configuration suitable for the transfer of fluid in the fluid chamber 340 between the first portion 342 and the second portion 344, e.g., between two portions of the fluid chamber 340 separated by the tubular-contact assembly 330, the isolating member 360, seals (e.g., seals 391, 392, 393, 394, or combinations thereof), or combinations thereof, as described herein. The passage 348 may have a width (e.g., diameter) suitable such that fluid freely transfers between the first portion 342 and the second portion 344 of the fluid change 340 such that the fluid pressure in the first portion 342 is equalized with the fluid pressure in the second portion 344. For example, the width (e.g., diameter) of the passage 348 may be about 10 mm or less; alternatively, about 5 mm or less; alternatively, about 1 mm or less; alternatively, about 0.5 inch or less; alternatively, about 0.25 inch or less; alternatively, about 0.125 inch or less; alternatively, about 0.0625 inch or less.

The tubular-contact assembly 330 may comprise a wheel, a roller, a slide block, a tractor arrangement, a contact arm or rod, or the like, which has a contact surface 334 configured to receive an acoustic signal when in contact with the tubular wall 315 of tubular 302. The tubular-contact assembly 330 may further comprise a mount 338 coupled to the contact surface 334 and one or more guide member(s) 339 extending from the mount 338 to contact one or more wall(s) 347 of the first portion 342 of the fluid chamber 340.

Generally, a portion (e.g., contact surface 334, mount 338, or combinations thereof) of the tubular-contact assembly 330 may generally protrude through the front plate 312 of the housing 310 along (additionally or alternatively, parallel to) axis 306 and contact the wall 315 of the tubular 302. The remainder (e.g., the mount 338, end 332, or combinations thereof) of the tubular-contact assembly 330 may reside in, and move along axis 306 within, the fluid chamber 340. In an embodiment, the tubular-contact assembly 330 may be positioned between the upper end 320 and the lower end 323 of the housing 310.

In an embodiment, the tubular-contact assembly 330 may be movable in the fluid chamber 340 in a direction generally perpendicular to a longitudinal axis 304 of the tubular 302 and/or generally along axis 306. The tubular-contact assembly 330 may move (e.g., with guide member(s) 339 slideably engaged with wall(s) 347) in response to a movement of the tubular 302, a vibration (e.g., acoustic signal, noise, or combinations thereof), or combinations thereof.

A seal 395 may be positioned between the front plate 312 and the mount 338 of the tubular-contact assembly 330 to prevent fluid from outside the fluid chamber 340 from flowing into the fluid chamber 340, to prevent fluid from within the fluid chamber 340 from flowing outside the fluid chamber 340, or combinations thereof.

As shown in FIG. 3B, the isolating member 360 is generally slideably positioned within the fluid chamber 340 such that axis 306 is the longitudinal axis of the isolating member 360. The isolating member 360 may comprise a cylindrical body with an hour-glass recess formed therein. In an embodiment, the isolating member 360 may comprise a first hollow portion 362 (e.g., one end of the hour-glass recess) adjacent to the first portion 342 of the fluid chamber 340, a second hollow portion 366 (e.g., the other end of the hour-glass recess)

adjacent and opening to the second portion 344 of the fluid chamber 340, a guide portion 364 (e.g., the bottleneck of the hour-glass recess), or combinations thereof. In embodiments, the guide portion 364 may be a bore, passage, or bottleneck positioned between the first hollow portion 342 and the second hollow portion 366. In an embodiment, the second hollow portion 366 may comprise an outer diameter smaller than a width of the second portion 342 of the fluid chamber 340 such that a fluid channel 368 is formed between the second hollow portion 366 and the fluid chamber 340 through which fluid may flow to and from the second portion 366 via the passage 348.

In an embodiment, the isolating member 360 may couple to an end 332 of the tubular-contact assembly 330. For example, the end 332 of the tubular-contact assembly 330 may be inserted inside the first hollow portion 362 and in sealed relationship with the isolating member 360 via seals 393 and 394 positioned between the first hollow portion 362 of the isolating member 360 and the end 332 of the tubular-contact assembly 330. In additional or alternative embodiments, the end 332 of the tubular-contact assembly 330 may be retained within the first hollow portion 362 with adhesives, by welding, by interference-fit relationship, by threads, the like, or combinations thereof. In an additional or alternative embodiment, the isolating member 360 may be integrally formed with the tubular-contact assembly 330.

In an embodiment, the isolating member 360 may be configured to limit a movement of the tubular-contact assembly 330 to movement along axis 306, constrain the tubular-contact assembly 330 against motions parallel with axis 304, or combinations thereof.

In an embodiment, the isolating member 360 may be configured to isolate the acoustic-signal receiver 370 from fluid in the fluid chamber 340. Particularly, the isolating member 360 may isolate fluid in the first portion 342 of the fluid chamber 340 from fluid in the second portion 344 of the fluid chamber 340. For example, one or more seals (e.g., a pair of seals 392) may be placed between the second hollow portion 364 of the isolating member 360 and a part of the communication member 380 364 (e.g., the first sealed member 382) extending through the interior of the second hollow portion to prevent fluid in the second portion 344 of the fluid chamber 340 from contacting the acoustic-signal receiver 370. Additionally, one or more seals (e.g., seal 391) may be placed between the isolating member 360 and the wall 345 of the second portion 344 of the fluid chamber 340. Additionally, one or more seals (e.g., seal 394 and seal 393) may be placed between the first hollow portion 362 of the isolating member 360 and the end 332 of the tubular-contact assembly 330 to prevent fluid in the first portion 342 of the fluid chamber 340 from contacting the acoustic-signal receiver 370.

Generally, the acoustic-signal receiver 370 may be positioned within the fluid chamber 340 and coupled to the tubular-contact assembly 330, the isolating member 360, or both. As seen in the embodiment of FIG. 3B, the acoustic-signal receiver 370 may be positioned in the first hollow portion 342 of the isolating member 360. Fluid in the fluid chamber 340 may not reach the acoustic-signal receiver 370 because of the isolation provided by the isolating member 360. In an embodiment, the acoustic-signal receiver 370 may sense an acoustic signal. In an embodiment, the acoustic-signal receiver 370 may comprise an accelerometer. The accelerometer may comprise any suitable accelerometer recognized by those skilled in the art with the aid of this disclosure. For example, the acoustic-signal receiver 370 may comprise a tri-axial sensor. In embodiments, the acoustic-signal receiver 370 may sense acoustic signals travelling parallel to axis 306, parallel to axis 304, or combinations thereof.

In an embodiment, the resilient member 350 may be positioned between a shoulder 343 of the fluid chamber 340 and the tubular contact assembly 330. In an embodiment, the resilient member 350 may be positioned around the tubular-contact assembly 330, isolating member 360, or combinations thereof. In an embodiment, the resilient member 350 may be positioned between the shoulder 343 (e.g., the back member 314 defining the shoulder 343) of the fluid chamber 340 and the tubular-contact assembly 330 such that the resilient member 350 abuts the shoulder 343 of the fluid chamber 340 and a shoulder 337 of the tubular-contact assembly 330. In an embodiment, the resilient member 350 may comprise a mechanical resonance frequency below the frequency of the acoustic signal. In an embodiment, the resilient member 350 may be configured to dampen a movement of the tubular-contact assembly 330 within the first portion 342 of the fluid chamber 340. Additionally or alternatively, the resilient member 350 is configured to provide structural isolation between the tubular-contact assembly 330 and the remainder of the PBASR apparatus 300. Additionally or alternatively, the resilient member 350 is configured to acoustically isolate the acoustic signal receiver 370 from noise frequencies associated with operation of the PBASR apparatus 300. The resilient member 350 may acoustically isolate the acoustic signal receiver 370 by attenuating noise frequencies above about 100 Hz; alternatively, by attenuating noise frequencies above frequencies in the range of from about 5 Hz to about 500 Hz; alternatively, by attenuating noise frequencies which comprise vibrations in a range of from about 1,000 Hz to about 3,000 Hz. The attenuation of frequencies may prevent undesirable noise frequencies (e.g., vibrations) from transmitting to the acoustic-signal receiver 370.

In an embodiment, the resilient member 350 may comprise a wave spring. The resilient member 350 may have greater than about a 25 lb force; alternatively, greater than about a 50 lb force; alternatively, greater than about a 100 lb force. In an embodiment, the resilient member 350 may have about a 50 lb force. The force and/or pressure of the resilient member 350 may provide a contact force and/or contact pressure to the tubular-contact assembly 330. The contact force and/or contact pressure may urge the tubular-contact assembly 330 into contact with the tubular wall 315 of tubular 302. In an embodiment, the contact force and/or contact pressure may be constant, continuous or combinations thereof. In additional or alternative embodiments, the resilient member 350 may reduce a force and/or pressure of an actuator (e.g., first actuator 326, second actuator 356, or combinations thereof) on the tubular-contact assembly 330. In an additional or alternative embodiment, the tubular-contact assembly 330 may compress the resilient member 350.

In general, the communication member 380 communicates information provided by the acoustic-signal receiver 370 out of the PBASR apparatus 300 (e.g., via communication member 380 disposed within a bore of rod member 316), for example, a data processor (e.g., data processor 116 of FIG. 1). The communication member 380 may comprise suitable rods, wires, connectors, etc., which enable the communication of the information. In an embodiment, the communication member 380 may comprise a wireless device to communicate the information to a data processor (e.g., data processor 116 of FIG. 1). In an alternative or additional embodiment, the communication member 380 may comprise a resilient or flexible portion 386 to communicate information to a data processor (e.g., data processor 116 of FIG. 1) via a wired connection. In embodiments, the communication member 380 may comprise a first sealed connector 382 and/or a second sealed connector 384. The first sealed connector 382 may be configured to prevent fluid in the fluid chamber 340 from entering the first hollow portion 362 (e.g., via second hollow portion 366 and guide portion 364) of the isolating member 360. Alternatively or additionally, the first sealed connector 382 may be configured to centralize the communication member 380 (e.g., via seals 392, guide portion 364, or combinations thereof) along axis 306. In an embodiment, the first sealed connector 382 may have a fluid-tight seal (e.g., via seals 392) with the isolating member 360 (e.g., with the second hollow portion 366 of the isolating member 360). The second sealed connector 384 is configured to prevent fluid in the fluid chamber 340 from entering a bore of the rod member 316. In an embodiment, the second sealed connector 384 may have a fluid-tight seal (e.g., via one or more seals 390) with the rod member 316. In an embodiment, the second sealed connector 384 may have a "hard" mechanical connection to the housing 310 (e.g., via rod member 316), while the first sealed connector 382 may have a "soft" mechanical connection to the second sealed connector 384, for example, via the resilient or flexible portion 386 of the communication member 380. A "hard" mechanical connection may comprise a rigid contact of component parts (e.g., the second sealed connector 384 with the housing 310; whereas, a "soft" mechanical connection does not have a rigid contact and instead may have a resilient or flexible contact which can reduce and/or prevent vibrations and/or acoustic signals external to the housing 310 from interrupting or compromising the receipt of acoustic signals from the tubular wall 315 of the tubular 302 by the tubular-contact assembly 330, the isolating member 360, and the acoustic-signal receiver 370.

The resilient or flexible portion 386 of the communication member 380 may be positioned within the second portion 344 of the fluid chamber 340. The resilient or flexible portion 386 of the communication member 380 may be positioned between the first sealed connector 382 and the second sealed connector 384. The resilient or flexible portion 386 may be configured to expand and contract as the tubular-contact assembly 330 responds to acoustic signals and movements of the tubular 302. The resilient or flexible portion 386 may provide a free-floating effect of i) the portion of the communication member 380 contained within the fluid chamber 340, ii) of the isolating member 360, iii) of the tubular-contact assembly 330, iv) or combinations thereof, with respect to the housing 310 (e.g., back member 314, rod member 316, upper end 320, lower end 323, or combinations thereof). In an embodiment, the resilient or flexible portion 386 of the communication member 380 may comprise a coiled wire, for example, a coated, coiled "telephone handset receiver" type wire. In embodiments, information generated by the acoustic-signal receiver 370 may be transmitted through the resilient or flexible portion 386 of the communication member 380, for example, to an exterior electronic component such as data processor 116.

In embodiments, the communication member 380 may extend through guide portion 364 of the isolating member 360. The guide portion 364 may contact the communication member 380, and the communication member 380 may be movable, e.g., slideable, within the guide portion 364 while in contact with the guide portion 364. In embodiments, the contact between the communication member 380 and the guide portion 364 may support the communication member 380 from sagging at the resilient or flexible portion 386. In additional or alternative embodiments, the contact between the communication member 380 and the guide portion 364 may guide any movement of communication member 380 (e.g., in response to a movement of the tubular-contact assembly 330, the isolating member 360, or combinations thereof) along a longitudinal axis 306 of the tubular-contact assembly 330.

In an embodiment, the communication member 380 may extend within the isolating member 360, the fluid chamber 340, the second portion 344 of the fluid chamber 340, the rod member 316, an actuator (e.g., first actuator 226 or second actuator 256 of FIGS. 2A and 2B), or combinations thereof. In an embodiment, at least a portion of the communication member 380 may extend through an actuator (e.g., first actuator 226 or second actuator 256 of FIGS. 2A and 2B), for example, to an exterior electronic component such as data processor 116.

Suitable seals (e.g., seals 390, 391, 392, 393, 394, 395, or combinations thereof) as described herein, such as o-rings, may be recognized by those skilled in the art with the aid of this disclosure. Suitable materials for the seals may include but are not limited to polymers, elastomers, or combinations thereof. The seals (e.g., seals 390, 391, 392, 393, 394, 395, or combinations thereof) may be configured to isolate (e.g., fluidly, mechanically (e.g., to prevent metal-to-metal contact), acoustically, or combinations thereof) the tubular-contact assembly 330, isolating member 360, communication member 380, components thereof, or combinations thereof from one another and/or from other components of the PBASR apparatus 300 (e.g., other housings, other actuators, rod member 316, upper end 320, lower end 323, back member 314, front plate 312, or combinations thereof).

In embodiments, the seals (e.g., seals 390, 391, 392, 393, 394, 395, or combinations thereof) may be configured to provide centralizing forces in a direction radial to axis 306. In embodiments, seals 393, 394, and 395 are configured to centralize the tubular-contact assembly 330 along axis 306. In embodiments, seals 390, 391, and/or 392 may be configured to centralize the isolating member 360, the communication member 380, the acoustic-signal receiver 370, or combinations thereof, along axis 306.

Operation of the PBASR apparatus 300 will now be discussed. Although operation as to the embodiments shown in FIGS. 2A, 2B, 3A, and 3B is described, variations of operation consistent with the disclosed embodiments is contemplated within the scope of this disclosure. As discussed for FIGS. 2A and 2B above, embodiments of the PBASR apparatus (e.g., apparatus 200 of FIGS. 2A and 2B) may extend and retract the housings 210 and 240 along the axis 206 to move the PBASR apparatus 200 to and from an extended position (see FIG. 2A), a retracted position (see FIG. 2B), or positions in between. Referring back to FIG. 3B, the housing 310 of the PBASR apparatus 300 can be seen in the extended position, and the bushings 321 and 324 and the tubular contact assembly 330 are in contact with the tubular wall 315 of the tubular 302.

Just before contact of the tubular wall 315 with the PBASR apparatus 300, the tubular-contact assembly 330 extended further toward the tubular wall 315 than did the bushings 321 and 324. As the housing 310 extended further toward the tubular wall 315, the contact surface 334 of the tubular-contact assembly 330 contacted the tubular wall 315. As the housing 310 extended still further toward the tubular wall 315, and before the bushings 321 and 324 contacted the tubular wall 315, the tubular-contact assembly 330 moved slightly inward of the fluid chamber 340 as the housing 310 continued to extend toward the tubular wall 315, and the tubular-contact assembly 330 compressed the resilient member 350 between the mount 338 of the tubular-contact assembly 330 and the shoulder 343 of the fluid chamber 340. The slight movement of the tubular-contact assembly 330 caused the isolating member 360 to slide with the tubular-contact assembly 330 along axis 306 within the fluid chamber 340. The slight movement of the tubular-contact assembly 330 also caused the acoustic-signal receiver 370 to slide with the tubular-contact assembly 330 and isolating member 360 along axis 306 within the fluid chamber 340. The slight movement of the tubular-contact assembly 330 also caused the portion of the communication member 380 positioned within the isolating member 360 to slide with the tubular-contact assembly 330, isolating member 360, and acoustic-signal receiver 370 along axis 306 within the fluid chamber 340. The resilient or flexible portion 386 of the communication member 380 positioned within the second portion 344 of the fluid chamber 340 contracted and/or flexed slightly in response to the movement of the tubular-contact assembly 330, isolating member 360, acoustic-signal receiver 370, and the portion of the communication member 380 positioned within the isolating member 360. The resilient or flexible portion 386 of the communication member 380 maintained an information connection between the first sealed connector 382 and the second sealed connector 384 of the communication member 380 for the communication of information from the acoustic-signal receiver 370 and out of the PBASR apparatus 300 while providing a "soft" mechanical connection between the first sealed connector 383 of the communication member 380 (and thus the tubular-contact assembly 330, isolating member 360, acoustic-signal receiver 370) and the second sealed connector 384 of the communication member 380 contained within rod member 316.

Upon contact of the tubular-contact assembly 330 with the tubular wall 315 of the tubular 302, and before contact of the bushings 321 and 324 with the tubular 315 of the tubular 302, fluid in the second portion 344 of the fluid chamber 340 experiences a pressure increase in response to the slight movement of the tubular-contact assembly 330 and isolating member 360 along axis 306 inward toward the second sealed connected 384 of the communication member 380. At this moment, the pressure of fluid in the second portion 344 of the fluid chamber 340 is greater than the pressure of fluid in the first portion 342 of the fluid chamber 340. As such, fluid in the second portion 344 flows through passage 348 to the first portion 342, and the fluid pressure in both the first portion 342 and second portion 344 of the fluid chamber equilibrates. As the tubular-contact assembly 330 and isolating member 360 move outward of the fluid chamber 340 toward the tubular wall 315 (e.g., in response to vibrations of the tubular 302 or a retraction of the housing 310 away from the tubular wall 315), the pressure in the first portion 342 of the fluid chamber 340 becomes greater than the pressure of the fluid in the second portion 344 of the fluid chamber 340. As such, fluid in the first portion 342 flows through passage 348 to the second portion 344, and the fluid pressure in the both the first portion 342 and the second portion 344 equilibrates.

After the tubular-contact assembly 330 contacts the tubular 315 and moves slightly as described above, the bushings 321 and 324 make contact with the tubular wall 315 of the tubular 302. The housing 310 may continue to extend (and in embodiments, compress the bushings 321 and 324) until the hard stops 322 and 324 of housing 310 meet the hard stops of a corresponding housing (e.g., housing 240 of FIGS. 2A and 2B) of the PBASR apparatus 300. Once the hard stops 322 and 324 make contact, the bushings 321 and 324 and/or the contact surface 334 of the tubular-contact assembly 330 have contacted the tubular wall 315.

After the hard stop 322 and 325 make contact with hard stops of a corresponding housing, the housing 310 is in the extended position, the bushings 321 and 324 are wrapped around the tubular 302, and the tubular-contact assembly 330 is in contact with the tubular wall 315. At this point, the contact surface 334 of the tubular-contact assembly 330 may receive an acoustic signal from the tubular wall 315 of the tubular 302. The acoustic signal may propagate through the tubular-contact assembly 330 to the acoustic-signal receiver 370. The acoustic-signal receiver 370 then converts the signal to information (e.g., an electric signal) which transmits through the communication member 380.

As described hereinabove, the PBASR apparatus 300 may contact the tubular wall 315 to receive and convert acoustic signals for information transmittal to a data processor (e.g., data processor 116 of FIG. 1). The PBASR apparatus 300 contacts the tubular wall 315 of the tubular 302 with a first contact pressure, a second contact pressure, a first contact force, a second contact force, or combinations thereof. The bushings 321 and 324 may have a first contact pressure and/or first contact force against the tubular wall 315, and the tubular-contact assembly 330 may have a second contact pressure and/or second contact factor against the tubular wall 315. For example, the resilient member 350 (e.g., via tubular contact assembly 330) may provide a contact pressure (e.g., second contact pressure) and/or contact force (e.g., second contact force) on the tubular wall 315 different than a contact pressure (e.g., first contact pressure) and/or contact force (e.g., first contact force) on the tubular wall 315 provided by other components of the PBASR apparatus 300 (e.g., upper end 320, lower end 323, bushing 321, bushing 324, first actuator 226, second actuator 256, or combinations thereof). In an additional or alternative embodiment, an actuator (e.g., first actuator 226, second actuator 256, or combinations thereof) may provide a first contact pressure and/or first contact force on the tubular wall 315 (e.g., via the upper end 320 and/or lower end 323 of the housing 310, bushing 321, bushing 324, or combinations thereof), and the tubular-contact assembly 330 may provide a second contact pressure and/or second contact force on the tubular wall 315 (e.g., via the tubular-contact assembly 330). In embodiments, the first contact pressure may be about equal to, greater than, or less than the second contact pressure. In additional or alternative embodiments, the first contact force may be about equal to, greater than, or less than the second contact force.

Generally, the contact pressure and/or contact force provided by the acoustic-signal receiving portion (e.g., tubular contact assembly 330) of the PBASR apparatus 300 may be at least partially independent of the contact pressure and/or contact force provided by the portion (e.g., the upper end 320 and/or lower end 323 of the housing 310, bushing 321, bushing 324, any actuators, or combinations thereof) of the PBASR apparatus 300 which grasps the tubular 302.

In embodiments, the contact pressure and/or contact force provided by the acoustic-signal receiving portion (e.g., tubular contact assembly 330) of the PBASR apparatus 300 may be less than the contact pressure and/or contact force provided by the portion (e.g., the upper end 320 and/or lower end 323 of the housing 310, bushing 321, bushing 324, or combinations thereof) of the PBASR apparatus 300 which grasps the tubular 302. For example, the contact pressure and/or contact force provided by the acoustic-signal receiving portion (e.g., tubular contact assembly 330) of the PBASR apparatus 300 may be less than about 100%, 90%, 80%, 70%, 60%, 50%, 40%, 30%, 20%, 10%, or less, of the contact pressure and/or contact force provided by the portion (e.g., the upper end 320 and/or lower end 323 of the housing 310, bushing 321, bushing 324, or combinations thereof) of the PBASR apparatus 300 which grasps the tubular 302.

Alternatively, the contact pressure and/or contact force provided by the acoustic-signal receiving portion (e.g., contact assembly 330) of the PBASR apparatus 300 may be greater than the contact pressure and/or contact force provided by the portion (e.g., the upper end 320 and/or lower end 323 of the housing 310, bushing 321, bushing 324, or combinations thereof) of the PBASR apparatus 300 which grasps the tubular 302. In such a scenario, the hard stops 322 and 325 may be designed so that bushings 321 and 324 experience little or no compression as the housing 310 of the PBASR apparatus 300 is moved to the extended position, for example, because of the oversized design (e.g., oversized diameter) of the bushings 324 and 321. For example, "little or no compression" may be construed as about equal to the contact pressure and/or contract force of the tubular-contact assembly 330 on the tubular wall 315; alternatively, less than about 100%, 90%, 80%, 70%, 60%, 50%, 40%, 30%, 20%, 10%, or less, of the contact pressure and/or contract force of the tubular-contact assembly 330 on the tubular wall 315. The contact force and/or contact pressure exerted against the tubular wall 315 by the bushings 321 and 324 may be significantly smaller than the contact pressure and/or contact force between the hard stops 322 and 325 of the PBASR apparatus 300. For example, "significantly less" may be construed as less than about 50% of the contact pressure and/or contact force between the hard stops 322 and 325 of the PBASR apparatus 300; alternatively, less than about 40% of the contact pressure and/or contact force between the hard stops 322 and 325 of the PBASR apparatus 300; alternatively, less than about 30% of the contact pressure and/or contact force between the hard stops 322 and 325 of the PBASR apparatus 300; alternatively, less than about 20% of the contact pressure and/or contact force between the hard stops 322 and 325 of the PBASR apparatus 300; alternatively, less than about 10% of the contact pressure and/or contact force between the hard stops 322 and 325 of the PBASR apparatus 300; alternatively, less than about 5% of the contact pressure and/or contact force between the hard stops 322 and 325 of the PBASR apparatus 300; alternatively, less than about 1% of the contact pressure and/or contact force between the hard stops 322 and 325 of the PBASR apparatus 300. The contact pressure and/or contact force provided by the acoustic-signal receiving portion (e.g., contact assembly 330) of the PBASR apparatus 300 may be greater than about 100%, 110%, 120%, 130%, 140%, 150%, 160%, 170%, 180%, 190%, or more, of the contact pressure and/or contact force provided by the portion (e.g., the upper end 320 and/or lower end 323 of the housing 310, bushing 321, bushing 324, or combinations thereof) of the PBASR apparatus 300 which grasps the tubular 302.

The embodiments disclosed hereinabove provide various advantages. For example, as described above, the disclosed embodiments may provide for different contact pressures and/or contact forces exerted on a tubular wall (e.g., tubular wall 315) from a single acoustic-signal receiving apparatus, e.g., embodiments of the PBASR apparatus disclosed herein. As such, the acoustic-signal receiving portion (e.g., tubular-contact assembly 330) of the PBASR apparatus 300 may receive acoustic signals from the tubular wall 315 of tubular 302 without choking the acoustic-signal-transmitting ability of the tubular 302 (e.g., at the point of contact of the tubular-contact assembly 330).

Additionally, the disclosed embodiments provide for pressure equilibration of fluid within the fluid chamber 340 which balances the pressure of fluid within the fluid chamber 340 and around the acoustic-signal receiver 370. As such, the fluid in the fluid chamber 340 may provide stabilization of the tubular contact assembly 330, isolating member 360, acoustic-signal receiver 370, communication member 380, or combinations thereof, from extraneous movement within the fluid chamber 340 caused by forces and/or pressures originating other than from the acoustic signal received from the tubular wall 315. Moreover, the fluid helps prevent the contact surface 334 from leaving contact with the tubular wall 315 of the tubular 302 due to extraneous noise and vibration.

Additionally, the disclosed embodiments provide for a "soft" mechanical connection between the acoustic-signal receiving portion (e.g., tubular contact assembly 330, isolating member 360, acoustic-signal receiver 370, or combinations thereof) and the rest of the housing 310, any actuators, or combinations thereof, which can reduce and/or prevent vibrations and/or acoustic signals external to the housing 310 from interrupting or compromising the receipt of acoustic signals from the tubular wall 315 of the tubular 302 by the acoustic-signal receiving portion (e.g., tubular contact assembly 330, isolating member 360, acoustic-signal receiver 370, or combinations thereof).

Additionally, the disclosed embodiments provide for oversized bushings 321 and 324 which may allow for play and movement of the tubular 302 therein. Thus, the bushings 321 and 324 do not exert a contact force and/or contact pressure which chokes the acoustic signal receivability of the tubular 302.

Additionally, because of the low contact force and/or contact pressure of the bushings 321 and 324 against the tubular wall 315, the bushings 321 and 324 may comprise a non-metallic material such as a composite or plastic, which provide low noise generation and can eliminate screech if the tubular 302 is moved through the bushings 321 and 324, e.g., while the PBASR apparatus 300 is in the extended position.

Additional Disclosure

The following are nonlimiting, specific embodiments in accordance with the present disclosure:

A first embodiment, which is a pressure-balanced acoustic-signal-receiving apparatus having a first housing, a first actuator coupled to the first housing, a second housing, and a second actuator coupled to the second housing, the first housing comprising:

- a fluid chamber comprising a first portion and a second portion;
- a passage fluidly connecting the first portion and the second portion;
- a tubular-contact assembly having an end positioned in the first portion of the fluid chamber, wherein the tubular-contact assembly comprises a contact surface configured to contact a tubular wall;
- an isolating member positioned within the fluid chamber and coupled to the tubular-contact assembly;
- an acoustic-signal receiver coupled to the tubular-contact assembly and positioned within the isolating member; and
- a communication member coupled to the acoustic signal receiver, wherein the communication member comprises a resilient portion positioned within the second portion of the fluid chamber.

A second embodiment, which is the apparatus of the first embodiment wherein at least a portion of the communication member extends through the first actuator.

A third embodiment, which is the apparatus of the first through second embodiments wherein the first housing further comprises:

a resilient member positioned in the first portion of the fluid chamber and configured to provide a contact force to the tubular-contact assembly.

A fourth embodiment, which is the apparatus of the first through third embodiments wherein a fluid pressure in the first portion of the fluid chamber equilibrates with a fluid pressure in the second portion of the fluid chamber via the passage.

A fifth embodiment, which is the apparatus of the first through fourth embodiments wherein the isolating member is configured to isolate the acoustic-signal receiver from fluid in the fluid chamber.

A sixth embodiment, which is the apparatus of the first through fifth embodiments wherein the first housing further comprises an upper end and a lower end, wherein the tubular-contact assembly is positioned between the upper end and lower end.

A seventh embodiment, which is the apparatus of the sixth embodiment wherein the first housing further comprises a bushing on the upper end and a bushing on the lower end.

An eighth embodiment, which is the apparatus of the first through seventh embodiments wherein the isolating member isolates fluid in the first portion of the fluid chamber from fluid in the second portion of the fluid chamber.

A ninth embodiment, which is the apparatus of the first through eighth embodiments wherein the tubular-contact assembly is movable within the fluid chamber in a direction perpendicular to a longitudinal axis of the tubular wall.

A tenth embodiment, which is a method for receiving an acoustic signal generated within a wellbore comprising:

receiving the acoustic signal with a tubular-contact assembly;

sensing the acoustic signal with an acoustic-signal receiver positioned within a fluid chamber and coupled to the tubular-contact assembly;

equilibrating a fluid pressure in a first portion of the fluid chamber with a fluid pressure of a second portion of the fluid chamber; and transmitting information generated by the acoustic-signal receiver through a communication member.

An eleventh embodiment, which is the method of the tenth embodiment further comprising:

isolating the acoustic-signal receiver from fluid in the fluid chamber.

A twelfth embodiment, which is the method of the tenth through eleventh embodiments further comprising:

extending at least a portion of the communication member within an actuator.

A thirteenth embodiment, which is the method of the tenth through twelfth embodiments further comprising:

extending a tubular into a wellbore; and contacting a tubular wall with the tubular-contact assembly.

A fourteenth embodiment, which is the method of the tenth through thirteenth embodiments further comprising:

contacting a tubular wall with the tubular-contact assembly;

retracting the tubular-contact assembly from contact with the tubular wall;

inserting a wellbore device into the wellbore past the tubular-contact assembly; and re-contacting the tubular wall with the tubular-contact assembly.

A fifteenth embodiment, which is the method of the tenth through fourteenth embodiments further comprising:

positioning a resilient portion of the communication member in the second portion of the fluid chamber.

A sixteenth embodiment, which is the method of the tenth through fifteenth embodiments wherein equilibrating a fluid pressure in a first portion of the fluid chamber with a fluid pressure of a second portion of the fluid chamber comprises flowing fluid from the first portion of the fluid chamber to the second portion of the fluid chamber via a passage, flowing fluid from the second portion of the fluid chamber to the first portion of the fluid chamber via the passage, or combinations thereof.

A seventeenth embodiment, which is the method of the tenth through sixteenth embodiments further comprising:

acoustically isolating the acoustic signal receiver with a resilient member.

An eighteenth embodiment, which is the method of the tenth through seventeenth embodiments further comprising:

contacting a tubular wall with the tubular-contact assembly;

compressing a resilient member with the tubular-contact assembly, an actuator, or combinations thereof; and providing a contact force to the tubular-contact assembly with the resilient member.

A nineteenth embodiment, which is a method for receiving an acoustic signal generated within a wellbore comprising:

contacting a tubular wall with a first contact force;

contacting the tubular wall with a second contact force;

receiving an acoustic signal with a tubular-contact assembly;

sensing the acoustic signal with an acoustic-signal receiver positioned within a fluid chamber and coupled to the tubular-contact assembly; and equilibrating a pressure in a first portion of the fluid chamber with a pressure of a second portion of the fluid chamber;

wherein the first contact force is greater than the second contact force.

A twentieth embodiment, which is the method of the nineteenth embodiment further comprising:

providing the first contact force with an actuator; and providing the second contact force with a resilient member, the tubular-contact assembly, or combinations thereof.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the disclosed subject matter.

What is claimed is:

1. A pressure-balanced acoustic-signal-receiving apparatus having a first housing, a first actuator coupled to the first housing, a second housing, and a second actuator coupled to the second housing, the first housing comprising:

a fluid chamber comprising a first portion and a second portion;

a passage fluidly connecting the first portion and the second portion;

a tubular-contact assembly having an end positioned in the first portion of the fluid chamber, wherein the tubular-contact assembly comprises a contact surface configured to contact a tubular wall;

an isolating member positioned within the fluid chamber and coupled to the tubular-contact assembly;

an acoustic-signal receiver coupled to the tubular-contact assembly and positioned within the isolating member; and a communication member coupled to the acoustic signal receiver, wherein the communication member comprises a resilient portion positioned within the second portion of the fluid chamber.

2. The apparatus of claim 1 wherein at least a portion of the communication member extends through the first actuator.

3. The apparatus of claim 1 wherein the first housing further comprises:

a resilient member positioned in the first portion of the fluid chamber and configured to provide a contact force to the tubular-contact assembly.

4. The apparatus of claim 1 wherein a fluid pressure in the first portion of the fluid chamber equilibrates with a fluid pressure in the second portion of the fluid chamber via the passage.

5. The apparatus of claim 1 wherein the isolating member is configured to isolate the acoustic-signal receiver from fluid in the fluid chamber.

6. The apparatus of claim 1 wherein the first housing further comprises an upper end and a lower end, wherein the tubular-contact assembly is positioned between the upper end and lower end.

7. The apparatus of claim 6 wherein the first housing further comprises a bushing on the upper end and a bushing on the lower end.

8. The apparatus of claim 1 wherein the isolating member isolates fluid in the first portion of the fluid chamber from fluid in the second portion of the fluid chamber.

9. The apparatus of claim 1 wherein the tubular-contact assembly is movable within the fluid chamber in a direction perpendicular to a longitudinal axis of the tubular wall.

10. A method for receiving an acoustic signal generated within a wellbore comprising:

receiving the acoustic signal with a tubular-contact assembly;

sensing the acoustic signal with an acoustic-signal receiver positioned within a fluid chamber and coupled to the tubular-contact assembly;

equilibrating a fluid pressure in a first portion of the fluid chamber with a fluid pressure of a second portion of the fluid chamber; and transmitting information generated by the acoustic-signal receiver through a communication member.

11. The method of claim 10 further comprising:

isolating the acoustic-signal receiver from fluid in the fluid chamber.

12. The method of claim 10 further comprising:

extending at least a portion of the communication member within an actuator.

13. The method of claim 10 further comprising:

extending a tubular into a wellbore; and contacting a tubular wall with the tubular-contact assembly.

14. The method of claim 10 further comprising:

contacting a tubular wall with the tubular-contact assembly;

retracting the tubular-contact assembly from contact with the tubular wall;

inserting a wellbore device into the wellbore past the tubular-contact assembly; and re-contacting the tubular wall with the tubular-contact assembly.

15. The method of claim 10 further comprising:

positioning a resilient portion of the communication member in the second portion of the fluid chamber.

16. The method of claim 10 wherein equilibrating a fluid pressure in a first portion of the fluid chamber with a fluid pressure of a second portion of the fluid chamber comprises flowing fluid from the first portion of the fluid chamber to the second portion of the fluid chamber via a passage, flowing fluid from the second portion of the fluid chamber to the first portion of the fluid chamber via the passage, or combinations thereof.

17. The method of claim 10 further comprising:

acoustically isolating the acoustic signal receiver with a resilient member.

18. The method of claim 10 further comprising:

contacting a tubular wall with the tubular-contact assembly;

compressing a resilient member with the tubular-contact assembly, an actuator, or combinations thereof; and providing a contact force to the tubular-contact assembly with the resilient member.

19. A method for receiving an acoustic signal generated within a wellbore comprising:

contacting a tubular wall with a first contact force;

contacting the tubular wall with a second contact force;

receiving an acoustic signal with a tubular-contact assembly;

sensing the acoustic signal with an acoustic-signal receiver positioned within a fluid chamber and coupled to the tubular-contact assembly; and equilibrating a pressure in a first portion of the fluid chamber with a pressure of a second portion of the fluid chamber;

wherein the first contact force is greater than the second contact force.

20. The method of claim 19 further comprising:

providing the first contact force with an actuator; and providing the second contact force with a resilient member, the tubular-contact assembly, or combinations thereof.

* * * * *